US009035543B2

(12) United States Patent
Fan

(10) Patent No.: US 9,035,543 B2
(45) Date of Patent: May 19, 2015

(54) LAMP AND ELECTRODE MODULE THEREOF

(71) Applicant: Lextar Electronics Corporation, Hsinchu (TW)

(72) Inventor: Yueh-Ying Fan, Hsinchu (TW)

(73) Assignee: LEXTAR ELECTRONICS CORPORATION, Hsinchu (TW)

( * ) Notice: Subject to any disclaimer, the term of this patent is extended or adjusted under 35 U.S.C. 154(b) by 0 days.

(21) Appl. No.: 14/178,071

(22) Filed: Feb. 11, 2014

(65) Prior Publication Data

US 2015/0097477 A1 Apr. 9, 2015

(30) Foreign Application Priority Data

Oct. 7, 2013 (TW) ..... 102136228 A

(51) Int. Cl.

| | |
|---|---|
| ***H01J 5/48*** | (2006.01) |
| ***H01J 5/50*** | (2006.01) |
| ***H05B 33/06*** | (2006.01) |
| ***H05B 33/26*** | (2006.01) |

(52) U.S. Cl.
CPC ..... *H05B 33/06* (2013.01); *H05B 33/26* (2013.01)

(58) Field of Classification Search
USPC ..... 313/491, 493, 631, 634, 318.01, 318.12
See application file for complete search history.

(56) References Cited

U.S. PATENT DOCUMENTS

| | | | | |
|---|---|---|---|---|
| 5,600,198 | A * | 2/1997 | Meade et al. | 313/318.01 |
| 7,514,872 | B2 * | 4/2009 | Smith et al. | 313/623 |
| 8,773,007 | B2 * | 7/2014 | Van De Ven et al. | 313/318.01 |
| 2001/0050523 | A1 * | 12/2001 | Van Lier et al. | 313/318.01 |
| 2006/0067076 | A1 * | 3/2006 | Shiang et al. | 362/288 |
| 2009/0295268 | A1 * | 12/2009 | Peng | 313/318.04 |
| 2011/0044042 | A1 * | 2/2011 | Liu et al. | 362/249.02 |
| 2012/0104928 | A1 * | 5/2012 | Huang et al. | 313/318.01 |
| 2012/0140480 | A1 * | 6/2012 | Taniuchi et al. | 362/296.01 |

FOREIGN PATENT DOCUMENTS

| | | |
|---|---|---|
| TW | 201245613 | 11/2012 |

* cited by examiner

*Primary Examiner* — Thomas A Hollweg
*Assistant Examiner* — Kevin Quarterman
(74) *Attorney, Agent, or Firm* — Moser Taboada

(57) ABSTRACT

A lamp electrode module includes a lamp cap, a spring electrode, a bottom electrode and a first insulation member. The lamp electrode has an inner sidewall surrounded by an internal thread and an inner bottom surface adjacent to the inner sidewall. The spring electrode has a helix portion wedged in the internal thread and a first connecting portion extended from the helix portion and located inside the lamp cap. The bottom electrode includes a contacting portion abutting against an outer surface opposite to the inner surface and a second connecting portion passing through the lamp cap and erecting on the inner bottom surface. The first insulation member covers the helix portion of the spring electrode and the inner sidewall of the lamp cap.

13 Claims, 5 Drawing Sheets

LAMP AND ELECTRODE MODULE THEREOF

RELATED APPLICATIONS

This application claims priority to Taiwan Application Serial Number 102136228, filed Oct. 7, 2013, which is herein incorporated by reference.

BACKGROUND

1. Field of Invention

The present invention relates to a lamp and an electrode module thereof.

2. Description of Related Art

In general, a conventional light emitting diode (LED) lamp includes a lamp cap and a lamp body, in which the lamp cap is connected to the bottom of the lamp body. A side surface and a bottom surface of the lamp cap are usually made of metal or electrically conductive material, and two electric wires from the lamp body individually bond with the side surface and the bottom surface of the lamp cap for conducting an external power supply.

At present, the two wires bond mostly by soldering or riveting with the side surface and the bottom surface of the lamp cap, which needs a vast investment in manufacturing equipment. As such, the assembling cost of the LED lamp increases and is not favorable for the mass production of the lamp.

SUMMARY

One aspect of the present invention provides a lamp and an electrode to solve the problem that mentioned in related art.

According to one embodiment of the present invention, a lamp electrode module includes a lamp cap, a spring electrode, a bottom electrode and a first insulation member. The lamp cap has an inner sidewall surrounded by an internal thread and an inner bottom surface adjacent to the inner sidewall. The spring electrode has a helical portion and a first connecting portion, in which the helical portion wedges in the internal thread, and the first connecting portion extends from the helical portion and is located inside the lamp cap. The bottom electrode has a contacting portion and a second connecting portion, in which the contacting portion abuts against an outer bottom surface of the lamp cap opposite to the inner bottom surface and the second connecting portion penetrates into the lamp cap and is erected on the inner bottom surface. A first insulation member covers the helical portion of the spring electrode and the inner sidewall of the lamp cap.

According to one embodiment of the present invention, the first insulation member bonds to the lamp cap, the spring electrode and the bottom electrode by insert molding.

According to one embodiment of the present invention, the lamp cap includes an outer sidewall opposite to the inner sidewall, and a second insulation member located between the inner sidewall and the inner bottom surface and between the outer sidewall and the outer bottom surface, so as to electrically isolate the inner sidewall from the inner bottom surface, and the outer sidewall from the outer bottom surface.

According to one embodiment of the present invention, a shape of the contacting portion of the bottom electrode is annular. The second connecting portion of the bottom electrode penetrates into the lamp cap, and the annular contacting portion abuts against the outer bottom surface.

According to one embodiment of the present invention, the lamp electrode module further includes a solder material disposed on the outer surface of the bottom electrode and covering the contacting portion.

According to one embodiment of the present invention, a pitch of the helix portion is equal to a pitch of the internal thread.

According to one embodiment of the present invention, an end of the first connecting portion and an end of the second connecting portion are parallel with each other.

According to one embodiment of the present invention, the helix portion is a metal wire successively surrounding the inner sidewall, and a width of a groove of the internal thread is greater than a wire diameter of the helix portion.

According to another embodiment of the present invention, the lamp includes a hollow lamp body and a lamp electrode module mentioned above. The hollow lamp body includes a first end and a second end, in which a light emitting unit is placed on the first end, and a power driving module is disposed inside the hollow lamp body and has a connector. The lamp electrode module is disposed on the second end and electrically connected to the connector. An end of the first connecting portion of the spring electrode of the lamp electrode module and an end of the second connecting portion of the bottom electrode are inserted into the connector.

According to another embodiment of the present invention, the light emitting unit includes a light emitting diode.

According to another embodiment of the present invention, the lamp includes a lamp cover disposed above the light emitting unit and fixed on the first end of the hollow lamp body.

According to another embodiment of the present invention, the first insulation member connects to the hollow lamp body by a way of hooking.

According to another embodiment of the present invention, the first insulation member has a hollow cylindrical shape, and an inner wall of the first insulation member has two sliding channels extending to a cylindrical opening such that two sides of the power driving module align with the two sliding channels to slide into the lamp cap.

In view of the above, since the lamp electrode module of the present invention is configured with two electrode wires, when the lamp electrode module of the present invention is joined to the hollow lamp body of the lamp, two electrodes wires of lamp electrode module can be directly inserted into the power driving module inside the hollow lamp body, and it is unnecessary to pull wires from the power driving module for connecting to the lamp electrode module by the ways of soldering or riveting.

BRIEF DESCRIPTION OF THE DRAWINGS

In order to make the invention as well as advantages thereof more apparent, the accompanying drawings are described as follows.

DETAILED DESCRIPTION

A modularize electrode lamp module and a lamp are disclosed by following embodiments of this invention. Such modularize electrode lamp module has two electrode wires arranged for being directly inserted into a power driving module inside a lamp and thus it is unnecessary to perform an act of soldering or riveting.

Figure 1:
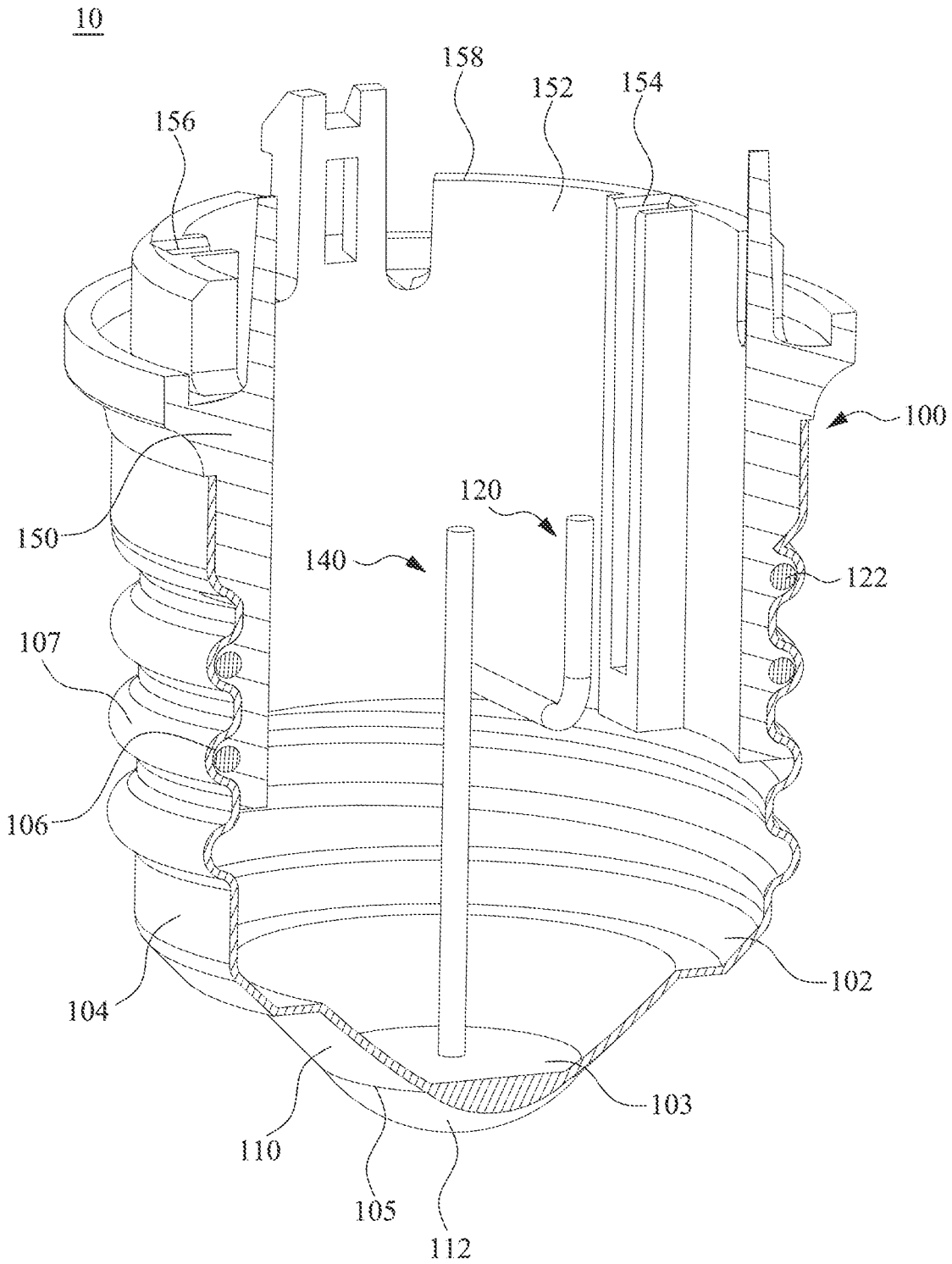
FIG. 1 illustrates a partial cross-sectional view of a lamp electrode module according to one embodiment of this invention.

FIG. 1 illustrates a partial cross-sectional view of a lamp electrode module according to one embodiment of this invention. Referring to FIG. 1, a lamp electrode module 10 includes a lamp cap 100, a spring electrode 120, a bottom electrode 140 and a first insulation member 150. In the present invention, the first insulation member 150 is used to made the spring electrode 120 combine with the lamp cap 120 and the bottom electrode is used to penetrate into the lamp cap 100 from the outside of the lamp cap 100, so as to form the modularize lamp electrode module 10 with two electrode wires.

The lamp cap 100 has an inner sidewall 102, an inner bottom surface 103, an outer sidewall 104 and an outer bottom surface 105. The inner sidewall 102 and the outer sidewall 104 are opposite to each other, and the inner bottom surface 103 and the outer bottom surface 105 are opposite to each other, in which the inner sidewall 102 is adjacent to the inner bottom surface 103 and the outer sidewall 104 is adjacent to the outer bottom surface 105.

Furthermore, the lamp cap 100 further includes a second insulation member 110. The second insulation member 110 can be an ring-shaped insulation member, which is connected and located between the inner sidewall 102 and the inner bottom surface 103 and between the outer sidewall 104 and the outer bottom surface 105, so as to electrically isolate the inner sidewall 102 from the inner bottom surface 103 and the outer sidewall 104 from the outer bottom surface 105.

The inner sidewall 102 of the present embodiment is surrounded by an internal thread 106, and the outer sidewall 104 is also surrounded by external threads 107 correspondingly. More specifically, a groove of the internal thread 106 is a ridge of the external threads 107, in which the external threads 107 is engaged with the outside electrical connecting seat and the internal thread 106 is engaged with the spring electrode 120.

Figure 2:
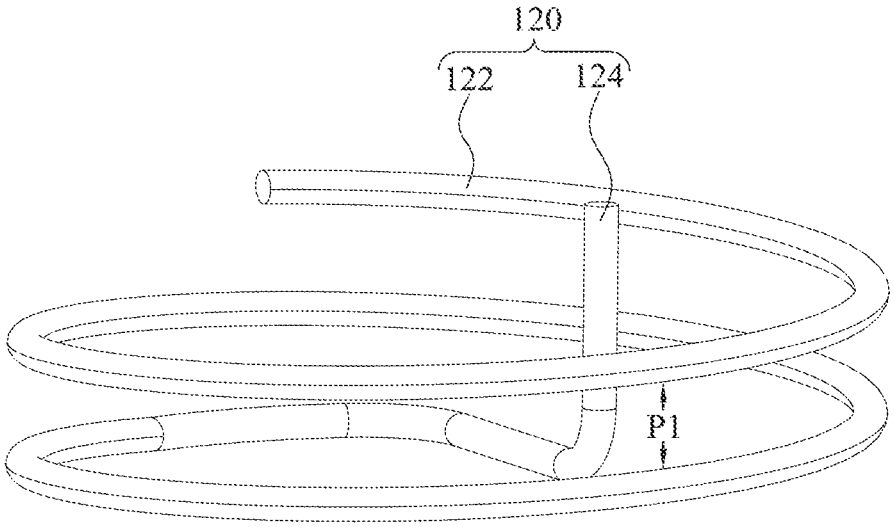
FIG. 2 illustrates a spring electrode according to one embodiment of this invention.
Figure 3:
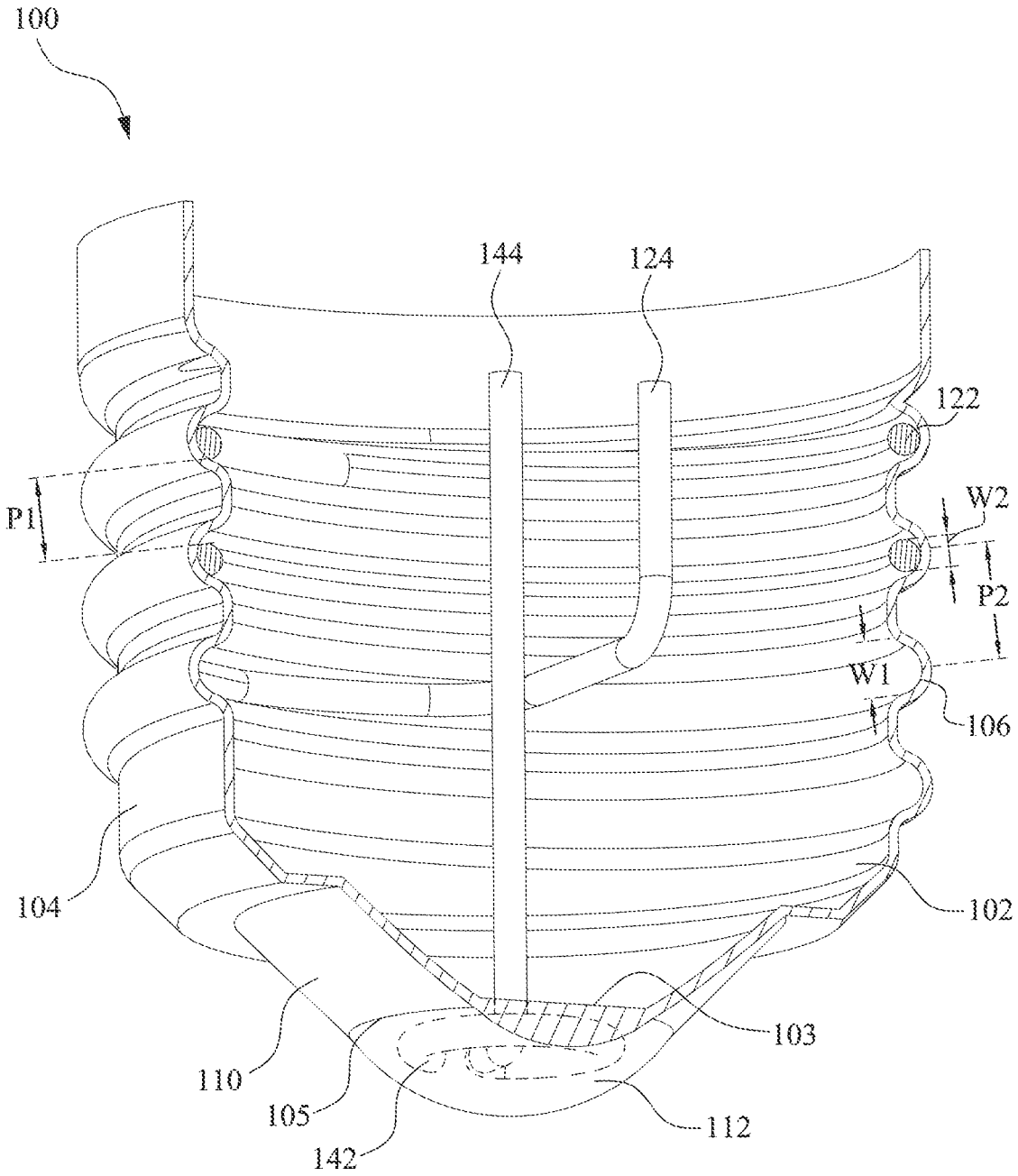
FIG. 3 illustrates a partial cross-sectional view of a lamp cap and electrodes according to one embodiment of this invention.

Referring to both FIG. 2 and FIG. 3, FIG. 2 illustrates a spring electrode according to one embodiment of the present invention, and FIG. 3 illustrates a partial cross-sectional view of a lamp cap and electrodes according to one embodiment of the present invention. As illustrated in figures, the spring electrode 120 has a helical portion 122 and a first connecting portion 124. The helical portion 122 of the present embodiment is like a helical spring, and is a metal wire successively surrounding the inner sidewall. The first connecting portion 124 extends from an end of the helical portion 122. Furthermore, the first connecting portion 124 is an electrode wire with a fixed rigidity, so as to stand in a space surrounded by the helical portion 122. A pitch P1 of the helix portion 122 of the spring electrode 120 is approximately equal to a pitch P2 of the internal thread 106, and a width W1 of the groove of the internal thread 106 is greater than a wire diameter W2 of the helix portion 122. As a result, during the process of manufacturing the lamp electrode module 10 of the present embodiment, the helix portion 122 can be directly engaged with the inner sidewall 102 of the lamp cap 100 along the groove of the internal thread 106, so that the helix portion 122 is wedged in the internal thread 106; meanwhile, the first connecting portion 124 stands inside the lamp cap 100.

Next, referring to FIG. 1 to FIG. 3, the bottom electrode 140 has a contacting portion 142 and a second connecting portion 144. The contacting portion 142 can be an annular electrode or a ring-shaped electrode but is not limited thereto, and the contacting portion 142 is used to abut against the outer bottom surface 105 of the lamp cap 100. In other embodiments of the present invention, the contacting portion 142 can be formed into various shapes, such as square, rectangle or oval. In the present embodiment, after the annular contacting portion 142 abuts against the outer bottom surface 105 of the lamp cap 105, the soldering material 112 can be disposed or coated on the outer bottom surface 105 of the lamp 100 to cover the contacting portion 142, so as to fix the contacting portion 142 on the outer bottom surface 105 of the lamp cap 100.

The second connecting portion 144 extends from an end of the contacting portion 142 and the second connecting portion 144 is a metal wire with a fixed rigidity, so as to stand on the contacting portion 144. During the assembling process of the lamp electrodes module 10 of the present embodiment, the second connecting portion 144 may directly penetrate into the lamp cap 100, so that the annular contacting portion 142 is abutted against the outer bottom surface 105 of the lamp cap 100, and the second connecting portion 144 stands on the inner bottom surface 103 of the lamp cap 100.

It is worthy mentioning that after the spring electrode 120 and the bottom electrode 140 is combined with the lamp cap 100. The first connecting portion 124 of the spring electrode 120 and the second connecting portion 144 of the bottom electrode 140 may be parallel to each other. Thus, when the lamp electrode module 10 of the present embodiment is connected to a relative driving module of a lamp, the first connecting portion 124 and the second connecting portion 144 may be directly inserted into a corresponding connector of the driving module.

Next, as illustrated in FIG. 1. after the spring electrode 120 and the bottom electrode 140 are combined with the lamp cap 100, the first insulation member 150 of the present embodiment at least covers the helix portion 122 of the spring electrode 120 and partial inner sidewall 102 of the lamp cap 100, so as to tightly combine the helix portion 122 with the inner sidewall 102 but is not limited thereto. In other embodiments of the present invention, the first insulation member 150 may cover the whole inner sidewall 102 and inner bottom surface 103 of the lamp cap 100, so as to insure that the bottom electrode 140 is tightly combined with the lamp cap as well.

More specifically, the first insulation member 150 bonds to the lamp cap 100, the spring electrode 120 and the bottom electrode 140 by insert molding, so as to tightly join the spring electrode 120 and the bottom electrode 140 with the inner surface (inner sidewall 102 and inner bottom surface 103) of the lamp cap 100. The first insulation member 150 may have a hollow cylindrical shape but is not limited thereto. An inner sidewall 152 of the hollow cylindrical-shaped first insulation member 150 may have a first sliding channel 154 and a second sliding channel 156. The first and the second sliding channels 154, 156 may be formed as two long and narrow paths, and extends along a direction from the inner bottom surface 103 to an opening 158 of the hollow cylindrical-shaped first insulation member 150. When the lamp electrode module 10 of the present embodiment is connected to the driving module of a relative lamp, the lateral sides of the driving module can be slid on two sliding channels 154, 156.

Figure 4:
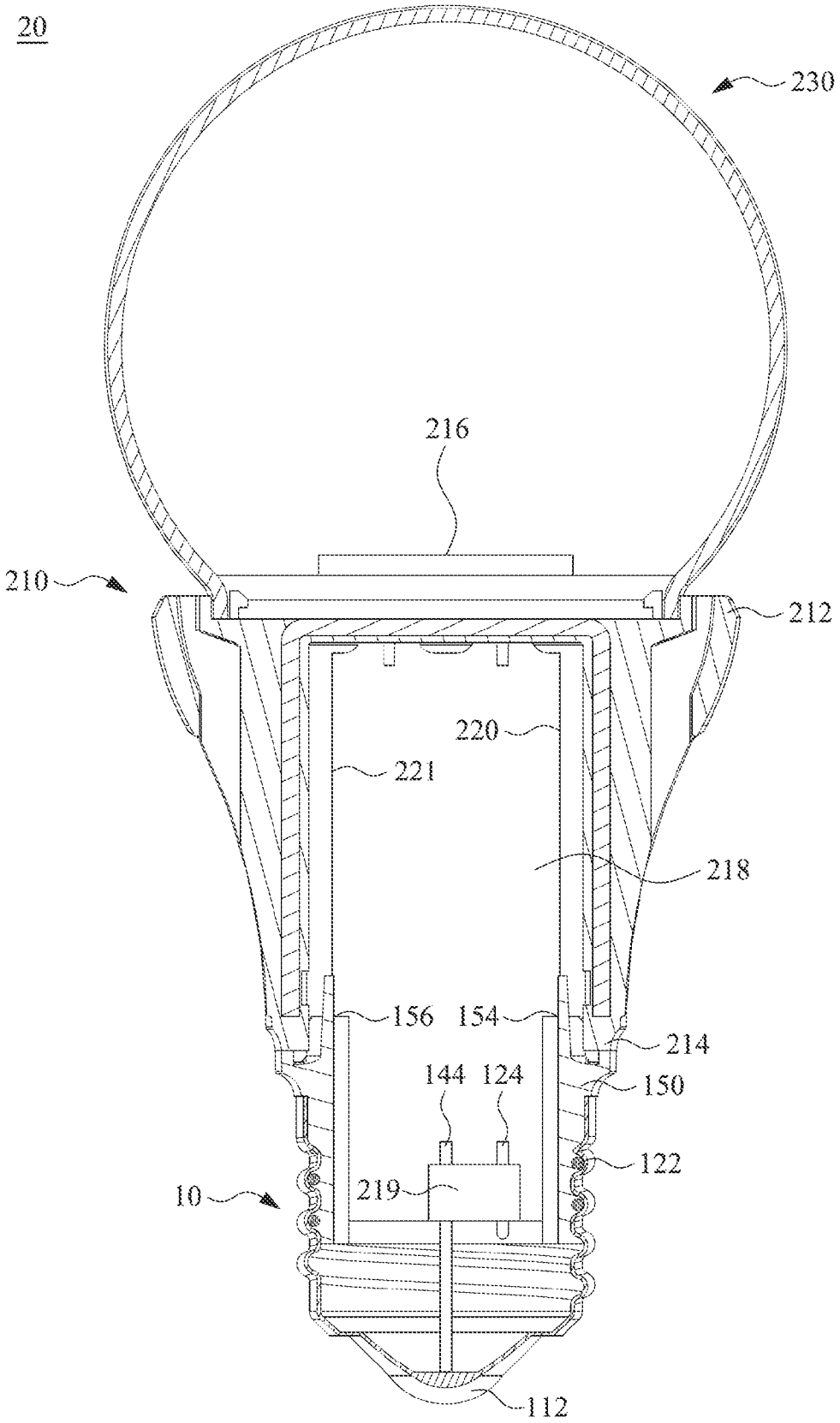
FIG. 4 illustrates a cross-sectional view of a lamp according to one embodiment of this invention.
Figure 5:
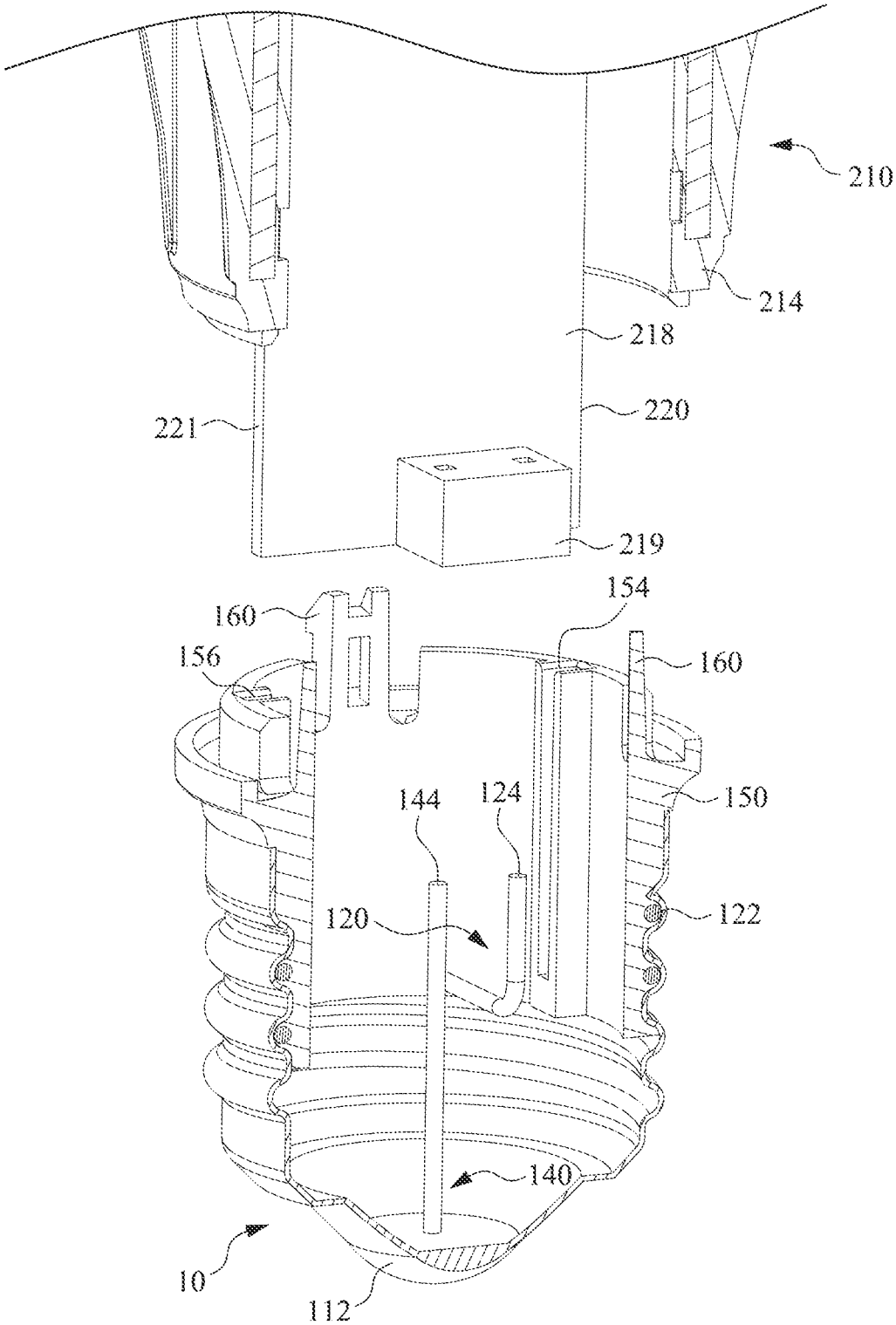
FIG. 5 illustrates a schematic view showing a connection between a lamp electrode module and a lamp body of a lamp according to one embodiment of this invention.

More particular, FIG. 4 and FIG. 5 respectively illustrates a cross-sectional view of the lamp and a schematic view showing a connection between a lamp electrode module and a lamp body according to one embodiment of the present invention. As illustrated in FIG. 4 and FIG. 5, a lamp 20 includes a hollow lamp body 210, a lamp electrode module 10 and a lamp cover 230. The hollow lamp body 210 has a first end 212 and a second end 214, in which the first end 212 is opposite to the second end 214, but is not limited thereto. The hollow lamp body 210 includes a light emitting unit 216 and a power driving module 218, in which the light emitting unit 216 may be a light emitting diode fixed on the first end 212 of the hollow lamp body 210, and the power driving module 218 is disposed inside the hollow lamp body 210.

The power driving module 218 has a connector 219 which may have two slots. The lamp electrode module 10 is disposed on the first end 213 and is electrically connected the connector 219. The lamp cover 230 is disposed above the light emitting unit 216 and is fixed on the first end 212 of the hollow lamp body 210, so as to cover the light emitting unit 216.

It is worthy mentioning that during the joining process of the lamp electrode module 10 and the hollow lamp body 210, an end of the first connecting portion 124 of the spring electrode 120 of the lamp electrode module 10 and an end of the second connecting portion 144 of the bottom electrode 140 are inserted into the slots of the connector 210 of the power driving module 218. Furthermore, the power driving module 218 may be a plate-like circuit board. During the joining process of the lamp electrode module 10 and the hollow lamp body 210, the lateral sides 220, 221 of the plate-like circuit board 218 are aligned with the sliding channels 154, 156 of the first insulation member 150 such that the plate-like circuit board 218 is capable of sliding along the sliding channels 154, 156 and being disposed inside the lamp cap 100.

In the present embodiment, the lamp electrode module 10 and the hollow lamp body 210 may assemble together by using two sliding channels 154, 156 of first insulation member 150. Besides, the first insulation member 150 may further include a hook member 160, and there is a bending part on an end of the hook member 160 so that the hook member 160 can be combined to the inner wall of the hollow lamp body 210 by a way of hooking. As a result, the present embodiment is capable of joining the lamp electrode module 10 and the hollow lamp body 210 without an act of soldering or riveting.

By using two electrode wires of the lamp electrode module disclosed in the above embodiments, when the lamp electrode module is combined with the lamp body of the lamp, two electrode wires of the lamp electrode module can be directly inserted into the power driving module without using the ways of soldering or riveting and also without pulling wires from the power driving module to the lamp electrode module. Furthermore, the lamp electrode module disclosed by the above embodiments may use a way of hooking to combine with the lamp body, so as to simplify the process of assembling the lamp electrode module and the lamp body. That is, after finishing manufacturing the lamp electrode module, the lamp electrode module is capable of directly hooking on the lamp body without using the manufacturing equipment.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A lamp electrode module, comprising:

a lamp cap having an inner sidewall surrounded by an internal thread and an inner bottom surface adjacent to the inner sidewall;

a spring electrode having a helical portion and a first connecting portion, the helical portion wedged in the internal thread, and the first connecting portion extending from the helical portion and being located inside the lamp cap;

a bottom electrode having a contacting portion and a second connecting portion, the contacting portion abutted against an outer bottom surface of the lamp cap opposite to the inner bottom surface, and the second connecting portion penetrating into the lamp cap and being erected on the inner bottom surface; and a first insulation member covering the helical portion of the spring electrode and the inner sidewall of the lamp cap.

2. The lamp electrode module of claim 1, wherein the first insulation member bonds to the lamp cap, the spring electrode and the bottom electrode by insert molding.

3. The lamp electrode module of claim 2, wherein the lamp cap comprises an outer sidewall opposite to the inner sidewall, and a second insulation member located between the inner sidewall and the inner bottom surface and between the outer sidewall and the outer bottom surface, so as to electrically isolate the inner sidewall from the inner bottom surface, and the outer sidewall from the outer bottom surface.

4. The lamp electrode module of claim 2, wherein a shape of the contacting portion of the bottom electrode is annular, the second connecting portion of the bottom electrode penetrates into the lamp cap, and the annular contacting portion abuts against the outer bottom surface.

5. The lamp electrode module of claim 4, further comprising a soldering material disposed on the outer bottom surface of the bottom electrode and covering the contacting portion.

6. The lamp electrode module of claim 2, wherein a pitch of the helix portion is equal to a pitch of the internal thread.

7. The lamp electrode module of claim 2, wherein an end of the first connecting portion and an end of the second connecting portion are parallel with each other.

8. The lamp electrode module of claim 2, wherein the helix portion is a metal wire successively surrounding the inner sidewall, and a width of a groove of the internal thread is greater than a wire diameter of the helix portion.

9. A lamp, comprising:

a hollow lamp body comprising a first end and a second end, wherein a light emitting unit is placed on the first end, and a power driving module is disposed inside the hollow lamp body and has a connector; and a lamp electrode module disposed on the second end and electrically connected to the connector, the lamp electrode module comprising:

a lamp cap having an inner sidewall surrounded by an internal thread and an inner bottom surface adjacent to the inner sidewall;

a spring electrode having a helical portion and a first connecting portion, the helical portion wedged in the internal thread, and the first connecting portion extending from the helical portion and being located inside the lamp cap;

a bottom electrode having a contacting portion and a second connecting portion, the contacting portion abutted against an outer bottom surface of the lamp cap opposite to the inner bottom surface, and the second connecting portion penetrating into the lamp cap and being erected on the inner bottom surface; and a first insulation member covering the helical portion of the spring electrode and the inner sidewall of the lamp cap;

wherein an end of the first connecting portion of the spring electrode of the lamp electrode module and an end of the second connecting portion of the bottom electrode are inserted into the connector.

10. The lamp of claim 9, wherein the light emitting unit comprises a light emitting diode.

11. The lamp of claim 10, further comprising a lamp cover disposed above the light emitting unit and fixed on the first end of the hollow lamp body.

12. The lamp of claim 9, wherein the first insulation member connects to the hollow lamp body by a way of hooking.

13. The lamp of claim 12, wherein the first insulation member has a hollow cylindrical shape, and an inner wall of the first insulation member has two sliding channels extending to a cylindrical opening such that two sides of the power driving module align with the two sliding channels to slide into the lamp cap.

* * * * *